US005326682A

United States Patent [19]

Yamakawa

[11] Patent Number: 5,326,682

[45] Date of Patent: Jul. 5, 1994

[54] SILVER HALIDE COLOR PHOTOGRAPHIC MATERIAL

[75] Inventor: Katsuyoshi Yamakawa, Kanagawa, Japan

[73] Assignee: Fuji Photo Film Co., Ltd., Kanagawa, Japan

[21] Appl. No.: 82,976

[22] Filed: Jun. 29, 1993

[30] Foreign Application Priority Data

Jul. 8, 1992 [JP] Japan ..... 4-203238

[51] Int. Cl.[5] ..... G03C 7/38

[52] U.S. Cl. ..... 430/558; 430/384; 430/385

[58] Field of Search ..... 430/558, 384, 385

[56] References Cited

U.S. PATENT DOCUMENTS 4,910,127 3/1990 Sakaki et al. ..... 430/546

FOREIGN PATENT DOCUMENTS 4016418 5/1990 Fed. Rep. of Germany .

3141057 6/1988 Japan ..... 430/558

*Primary Examiner*—Lee C. Wright

*Attorney, Agent, or Firm*—Sughrue, Mion, Zinn, Macpeak & Seas

[57] ABSTRACT

A silver halide color photographic material containing a novel cyan coupler and capable of forming a cyan dye having a high color density and an excellent light fastness. The photographic light-sensitive material contains at least one 1H-imidazo[1,5-a]imidazole cyan coupler represented by the following Formula (I) in at least one layer provided on a support:

(I)

wherein $R^1$ represents a hydrogen atom or a substituent; $R^2$ and $R^3$ each represent a substituent, provided that at least one of $R^1$, $R^2$, $R^3$ and represents an electron attractive group; and X represents a hydrogen atom or a group capable of splitting off upon a reaction with an oxidation product of a color developing agent.

8 Claims, 1 Drawing Sheet

FIGURE
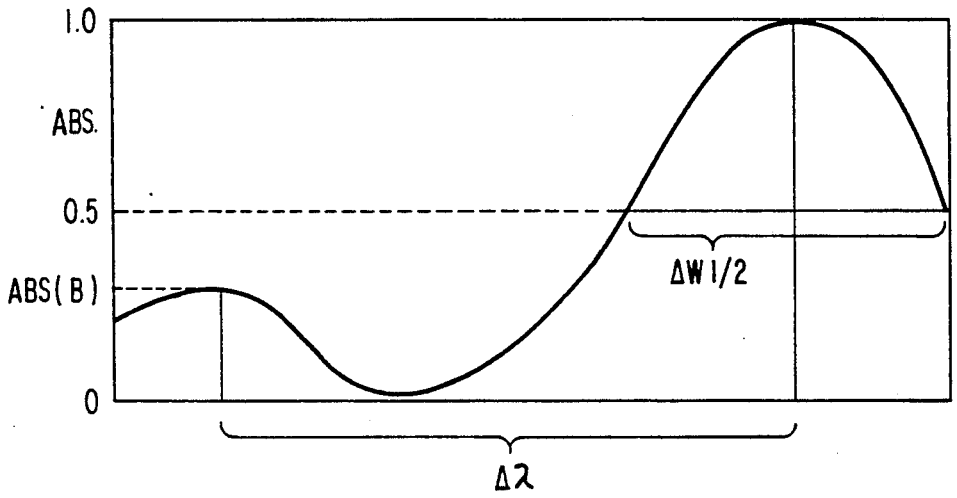

SILVER HALIDE COLOR PHOTOGRAPHIC MATERIAL

FIELD OF THE INVENTION

The present invention relates to a silver halide color photographic material containing a novel cyan dye-forming coupler (hereinafter referred to simply as a cyan coupler).

BACKGROUND OF THE INVENTION

In a silver halide color photographic material, there is now most widely used the system in which the reaction of dye-forming couplers coloring to yellow, magenta and cyan with color developing agents is utilized to form a color image.

In recent years, research has been conducted for improving dye-forming couplers to be used in the silver halide color photographic material from the viewpoint of providing improvements in color reproduction and image fastness, but it can not be said that such couplers have sufficiently been improved. In particular, with respect to a cyan coupler, a phenol series or naphthol series coupler has so far consistently been used, but the dyes formed from these couplers have undesired absorptions in the blue and green regions, which has become a large obstacle against the improvement in color reproduction. Further, the small molecular extinction coefficient of a formed cyan dye is also disadvantageous to improvement in the sharpness of an image.

Recently, research has been conducted on cyan dye-forming couplers containing a new skeleton having a nitrogen-containing heterocyclic group, and various heterocyclic compounds have been proposed. There are disclosed, for example, the diphenylimidazole series couplers described in U.S. Pat. No. 4,818,672, the pyrazoloazole series couplers described in JP-A-63-199352 (the term "JP-A" as used herein means an unexamined Japanese patent application), U.S. Pat. Nos. 4,916,051 and 4,873,183, JP-A-I-105250, and JP-A-1-105251, and the condensed imidazole series couplers described in DE 4,016,418A1. In any of these couplers, improvement in color reproduction is described and they are characterized by excellent absorption characteristics of a formed dye.

However, the dyes obtained from the above couplers have the defects that the absorptions thereof are shifted to a shorter wavelength, and that fastness to light and heat is inferior, and further have a serious problem in practical use because the coupling activity of the coupler itself is small.

SUMMARY OF THE INVENTION

A first object of the present invention is to provide a silver halide color photographic material containing a novel cyan coupler and capable of forming a cyan dye having a high color density and an excellent spectral absorption characteristic.

A second object of the present invention is to provide a silver halide color photographic material capable of forming a cyan dye having excellent light fastness.

The above and other objects of the present invention have been achieved by a silver halide color photographic material containing at least one 1H-imidazo[1,5-a]imidazole cyan coupler represented by the following Formula (I) in at least one layer provided on a support:

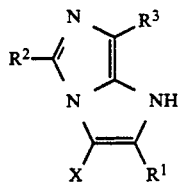

(I)

wherein $R^1$ represents a hydrogen atom or a substituent; $R^2$ and $R^3$ each represent a substituent, provided that at least one of $R^1$, $R^2$, $R^3$ represents an electron attractive group; and X represents a hydrogen atom or a group capable of splitting off upon a reaction with an oxidation product of a color developing agent.

DETAILED DESCRIPTION OF THE DRAWING

The sole figure of the drawing shows various absorption characteristics of dyes formed from the couplers employed in Example 2.

DETAILED DESCRIPTION OF THE INVENTION

A 1H-imidazo[1,5-a] imidazole cyan coupler represented by Formula (I) has analogous compounds represented by the following Formulas (II) and (III);

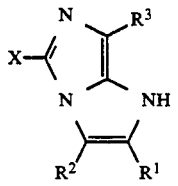

(II)

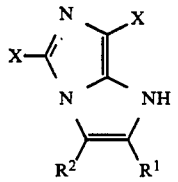

(III)

wherein $R^1$, $R^2$, $R^3$ and X are the same as defined in Formula (I) above.

In the present invention, most preferred is the 1H-imidazo[1,5-a] imidazole cyan coupler represented by Formula (I).

Formulas (I), (II) and (III) will be explained below in detail.

$R^1$ represents a hydrogen atom or a substituent and $R^2$ and $R^3$ each represent a substituent. The coupler of the present invention is characterized by effecting coupling reaction at a position of substitutent X. Accordingly, $R^1$, $R^2$ and $R^3$ never split off on coupling reaction. There can be enumerated as the substituent, an aryl group, an alkyl group, a cyano group, a formyl group, an acyl group, a carbamoyl group, an alkoxycarbonyl group, an aryloxycarbonyl group, a formylamino group, an acylamino group, an alkoxycarbonylamino group, an aryloxycarbonylamino group, a sulfonamido group, a ureido group, a sulfamoylamino group, an alkylamino group, an arylamino group, an alkoxy group, an aryloxy group, a heterocyclic oxy group, an alkylthio group, an arylthio group, a heretocyclic thio group, a heterocyclic group, a halogen atom, a hydroxy group, a nitro group, a sulfamoyl group, a sulfonyl group, an acyloxy group, a carbamoyloxy group, a sulfonyloxy group, an imido group, a sulfinyl group, a phosphoryl group, a carboxyl group, a phosphono group, and an unsubstituted amino group. Of these, the groups capable of further having a substituent may be substituted with the above substituents.

In the present specification, an acyl group, an acylamino group, a sulfoneamido group, a sulfonyl group, an acyloxy group and sulfinyl group, each, is bonded at alkyl moiety, aryl moiety or heterocyclic moiety.

To be specific, the substituents represented by $R^1$, $R^2$ and $R^3$ are an aryl group (preferably having a carbon number of 6 to 30, for example, phenyl, m-acetylaminophenyl, and p-methoxyphenyl), an alkyl group (preferably having a carbon number of 1 to 30, for example, methyl, trifluoromethyl, ethyl, isopropyl, heptafluoropropyl, t-butyl, n-octyl, and n-dodecyl), a cyano group, a formyl group, an acyl group (preferably having a carbon number of 2 to 30, for example, acetyl, pivaloyl, benzoyl, furoyl, and 2-pyridylcarbonyl), a carbamoyl group (preferably having a carbon number of 1 to 30, for example, methylcarbamoyl, ethylcarbamoyl, dimethylcarbamoyl, and n-octylcabamoyl), an alkoxycarbonyl group (preferably having a carbon number of 2 to 30, for example, methoxycarbonyl, ethoxycarbonyl, isopropoxycarbonyl, and diphenymethylcarbonyl), an aryloxycarbonyl group (preferably having a carbon number of 7 to 30, for example, phenoxycarbonyl, p-methoxyphenoxycarbonyl, m-chlorophenoxycarbonyl, and o-methoxyphenoxycarbonyl), a formylamino group, an acylamino group (an alkylcarbonylamino group preferably having a carbon number of 2 to 30 (for example, acetylamino, propionylamino, and cyanoacetylamino), an arylcarbonylamino group preferably having a carbon number of 7 to 30 (for example, benzoylamino, p-tolylamino, pentafluorobenzoylamino, and m-methoxybenzoylamino), and a heterocyclic carbonylamino group preferably having a carbon number of 4 to 30 (for example, 2-pyridylcarbonylamino, 3-pyridylcarbonylamino, and furoylamino)), an alkoxycarbonylamino group (preferably having a carbon number of 2 to 30, for example, methoxycarbonylamino, ethoxycarbonylamino, and methoxyethoxycarbonylamino), an aryloxycarbonylamino group (preferably having a carbon number of 7 to 30, for example, phenoxycarbonylamino, p-methoxyphenoxycarbonylamino, p-methylphenoxycarbonylamino, and m-chlorophenoxycarbonylamino), a sulfonamido group (preferably having a carbon number of 1 to 30, for example, methanesulfonamido, benzenesulfonamido, and p-toluenesulfonamido), a ureido group (preferably having a carbon number of 1 to 30, for example, methylureido, dimethylureido, and p-cyanophenylureido), a sulfamoylamino group (preferably having a carbon number of 1 to 30, for example, methylaminosulfonylamino, ethylaminosulfonylamino, and anilinosulfonylamino), an alkylamino group (preferably having a carbon number of 1 to 30, for example, methylamino, dimethylamino, ethylamino, diethylamino, and n-butylamino), an arylamino group (preferably having a carbon number of 6 to 30, for example, anilino), an alkoxy group (preferably having a carbon number of 1 to 30, for example, methoxy, ethoxy, isoproproxy, n-butoxy, methoxyethoxy, and n-dodecyloxy), an aryloxy group (preferably having a carbon number of 6 to 30, for example, phenoxy, m-chlorophenoxy, p-methoxyphenoxy, and o-methoxyphenoxy), a heterocyclic oxy group (preferably having a carbon number of 3 to 30, for example, tetrahydropyranyloxy, 3-pyridyloxy, 2-(1,3-benzimidazolyl) oxy), an alkylthio group (preferably having a carbon number of 1 to 30, for example, methylthio, ethylthio, n-butylthio, and t-butylthio), an arylthio group (preferably having a carbon number of 6 to 30, for example, phenylthio), a heterocyclic thio group (preferably having a carbon number of 3 to 30, for example, 2-pyridylthio, 2-(1,3-benzoxazolyl) thio, 1-hexadecyl-1,2,3,4-tetrazolyl-5-thio, and 1-(3-N-octadecylcarbamoyl) phenyl-1,2,3,4-tetrazolyl-5-thio), heterocyclic group (preferably having a carbon number of 3 to 30, for example, 2-benzoxazolyl, 2-benzothiazolyl, 1-phenyl-2-benzimidazolyl, 5-chloro-l-tetrazolyl, 1-pyrrolyl, 2-furanyl, 2-pyridyl, and 3-pyridyl), a halogen atom (fluorine, chlorine and bromine), a hydroxy group, a nitro group, a sulfamoyl group (preferably having a carbon number of 0 to 30, for example, methylsulfamoyl, dimethylsulfamoyl, ethylsulfamoyl, and N,N-dipropylsulfamoyl), a sulfonyl group (preferably having a carbon number of 1 to 30, for example, methanesulfonyl, benzenesulfonyl, toluenesulfonyl, trifluoromethanesulfonyl, and difluoromethanesulfonyl), an acyloxy group (preferably having a carbon number of 1 to 30, for example, formyloxy, acetyloxy, and benzoyloxy), a carbamoyloxy group (preferably having a carbon number of 1 to 30, for example, methylcarbamoyloxy and diethylcarbamoyloxy), a sulfonyloxy group (preferably having a carbon number of 1 to 30, for example, methanesulfonyloxy), an imido group (preferably having a carbon number of 4 to 30, for example, succinimido and phthalimido), a sulfinyl group (preferably having a carbon number of 1 to 30, for example, diethylamino-sulfinyl), a phosphoryl group (preferably having a carbon number of 0 to 30, for example, dimethoxyphosphoryl and diphenylphosphoryl), a carboxyl group, a phosphono group, and an unsubstituted amino group.

To be preferable, $R^1$ is an aryl group, an alkyl group, a cyano group, a carbamoyl group, or an alkoxycarbonyl group, more preferably, an aryl group, an alkyl group or a cyano group, and particularly preferably, a perfluoroalkyl group or a cyano group;

$R^2$ is an aryl group, an alkyl group, an acylamino group, an alkoxycarbonylamino group, sulfonamido group, a ureido group, or a heterocyclic group, more preferably, an aryl group, an alkyl group, or a heterocyclic group, and particularly preferably, an aryl group, an alkyl group, or a pyrazolyl group;

$R^3$ is an aryl group, an alkyl group, a cyano group, a carbamoyl group, or an alkoxycarbonyl group, more preferably an aryl group, an alkyl group, or a cyano group; and X is a hydrogen atom, a chlorine atom, an arylthio group, or an aryloxy group, more preferably, a hydrogen atom, or chlorine atom.

In the present invention, at least one of $R^1$, $R^2$ and $R^3$ is an electron attractive group. In the present specification, the electron attractive group is defined as a substituent (including an atom) having a Hammett's substitution constant $\sigma_p$ showing a positive value. In Formula (I) of the present invention, $R^1$ is preferably the electron attractive group in view of a hue.

The Hammett's substitution constant used in the present specification will briefly be explained below.

The Hammett's rule is the empirical rule which was proposed by L. P. Hammett in 1935 in order to quantitatively discuss the affects exerted by a substituent to a reaction or equilibrium of a benzene derivative. In these days, the propriety thereof is widely accepted. The $\sigma_p$ value and $\sigma_m$ value are available as the substituent constant obtained according to the Hammett's rule, and the values thereof are described in many general publications. They are described in, for example, *Lange's Handbook of Chemistry,* the 12th edition, edited by J. A. Dean, 1979 (McGraw-Hill), and *Chemical Region, Extra Edition,* No. 122, pp. 96 to 103, 1979 (Nankohdo). In the present invention, the respective substituents are regulated and explained by the Hammett's substituent constant $\sigma_p$ value, but this does not mean that they are limited to the substituents the $\sigma_p$ values of which are described in these publications. Even if the $\sigma_p$ values of the groups would not be described in the publications, there are naturally included for use in the present invention substituents which have a positive $\sigma_p$ value when they are measured according to the Hammett's rule.

There can be enumerated as an electron attractive group having a positive $\sigma_p$ value, a cyano group ($\sigma_p$ value: 0.66 ), a nitro group (0.78), a carboxyl group (0.45), a perfluoroalkyl group (for example, trifluoromethyl (0.54) and perfluorobutyl), an acyl group (for example, acetyl (0.50) and benzoyl (0.43)), a formyl group (0.42), a sulfonyl group (for example, trifluoromethanesulfonyl (0.92), methanesulfonyl (0.72), and benzenesulfonyl (0.70)), a sulfinyl group (for example, methanesulfinyl (0.49)), a carbamoyl group (for example, carbamoyl (0.36), methylcarbamoyl (0.36), phenylcarbamoyl, and 2-chloro-phenylcarbamoyl), an alkoxycarbonyl group (for example, methoxycarbonyl (0.45), ethoxycarbonyl, and diphenylmethoxycarbonyl ), an aryloxycarbonyl group ( for example, phenoxycarbonyl (0.40)), a heterocyclic group (for example, pyrazolyl (0.37) and 1-tetrazolyl (0.50)), an alkylsulfonyloxy group (for example, methanesulfonyloxy (0.36)), a phosphonyl group (for example, dimethoxyphosphonyl (0.60) and diphenylphosphonyl), a sulfamoyl group (0.57), a pentachlorophenyl group, a pentafluorophenyl group, and a sulfonyl group-substituted aromatic group ( for example, 2,4-dimethanesulfonylphenyl).

The electron attractive group in the present invention is an electron attractive group having preferably a Hammett's substituent constant $\sigma_p$ value of 0.3 or more. An upper limit of a Hammett's substituent constant $\sigma_p$ value is preferably 1.8, more preferably 1.6.

There can be enumerated as an electron attractive group having a Hammett's substituent constant $\sigma_p$ value of 0.3 or more, a cyano group, a nitro group, an acyl group, a carbamoyl group, a phosphono group, an alkoxycarbonyl group, an aryloxycarbonyl group, a phosphonyl group, a sulfamoyl group, a sulfonyl group, and a perfluoroalkyl group.

Preferably, examples are a cyano group, a perfluoroalkyl group, and an alkoxycarbonyl group, more preferably, a cyano group, and perfluoroalkyl group.

X represents a hydrogen atom or a group (hereinafter referred to as a coupling splitting group) capable of splitting off upon a coupling reaction with an oxidation product of a color developing agent, for example, an aromatic primary amine developing agent.

To enumerate specific examples of the coupling splitting group, they are a halogen atom (for example, fluorine, chlorine and bromine), an alkoxy group having 1 to 30 carbon atoms (for example, ethoxy, dodecyloxy, methoxyethylcarbamoylmethoxy, carboxypropyloxy, and methylsulfonylethoxy), an aryloxy group having 6 to 36 carbon atoms (for example, 4-chlorophenoxy, 4-methoxyphenoxy, and 4-carboxyphenoxy), an acyloxy group having 2 to 36 carbon atoms (for example, acetoxy, tetradecanoyloxy, and benzoyloxy), a sulfonyloxy group having 1 to 36 carbon atoms (for example, methanesulfonyloxy and toluenesulfonyloxy), an acylamino group having 2 to 36 carbon atoms (for example, dichloroacetylamino and heptafluorobutyrylamino), a sulfonamido group having 1 to 36 carbon atoms (for example, methanesulfonamido and p-toluenesulfonamido), an alkoxycarbonyloxy group having 2 to 30 carbon atoms (for example, ethoxycarbonyloxy and benzyloxycarbonyloxy ), an aryloxycarbonyloxy group having 7 to 36 carbon atoms ( for example, phenoxycarbonyloxy), an alkylthio group having 1 to 30 carbon atoms (for example, carboxymethylthio), an arylthio group having 6 to 36 carbon atoms ( for example, 2-butoxy-5-tert-octylphenyl thio ), a heterocyclic thio group having 1 to 36 carbon atoms (for example, tetrazolylthio), a carbamoylamino group having 2 to 36 carbon atoms ( for example, N-methylcarbamoylamino and N-phenylcarbamoylamino), a 5- or 6-membered nitrogen-containing heterocyclic group having 1 to 36 carbon atoms, which is bonded through nitrogen atom (for example, imidazolyl, pyrazolyl, triazolyl, tetrazolyl, and 1,2-dihydro-2-oxo-1-pyridyl), an imido group having 1 to 36 carbon atoms (for example, succinimido and hydantoinyl), an aromatic azo group (for example, phenylazo), a sulfinyl group having 1 to 36 carbon atoms (for example, 2-butoxy-5-tert-octylphenylsulfinyl), and a sulfonyl group having 1 to 36 carbon atoms (for example, 2-butoxy-5-tert-octylphenylsulfonyl). These groups may further be substituted with the groups allowed as the substituents for $R^1$.

A bis type coupler obtained by condensing a tetraequivalent coupler with aldehydes or ketones is available as the splitting group bonded via a carbon atom. The splitting group according to the present invention may contain photographically useful groups, such as a development inhibitor and a development accelerator.

In the present invention, X is particularly preferably a chlorine atom.

The coupler represented by Formulas (I) to (III) may have a coupler residue represented by Formulas (I) to (III) in the groups of $R^1$ to $R^3$ to form a polymer higher than a dimer, or the groups of $R^1$ to $R^3$ may have a polymer chain to form a homopolymer or copolymer. The homopolymer or copolymer of an addition polymer ethylene type unsaturated compound having a coupler residue represented by Formulas (I) to (III) is a typical example of a homopolymer or copolymer obtained by combining with a polymer chain. In this case, one or more kinds of the coloring repetitive unit having the coupler residue represented by Formulas (I) to (III) may be contained in the polymer and may be the copolymer containing one or more kinds of a non-coloring ethylene type monomer such as acrylic acid ester, methacrylic acid ester and maleic acid esters as the copolymer component.

Next, representative compound examples of the coupler used in the present invention will be shown, but the present invention is not limited thereto.

(I)
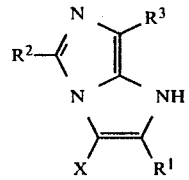
| | $R^1$ | $R^2$ | $R^3$ | X |
|---|---|---|---|---|
| (I)-1 | 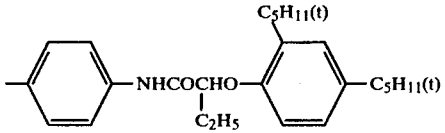 | 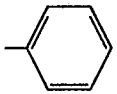 | CN | H |
| (I)-2 | 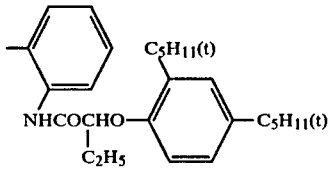 | 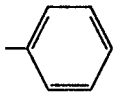 | CN | H |
| (I)-3 | 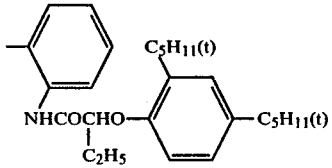 | 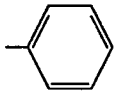 | CN | Cl |
| (I)-4 | 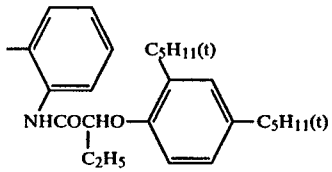 | $-CH_3$ | CN | Cl |

-continued
| | $R^1$ | $R^2$ | $R^3$ | X |
|---|---|---|---|---|
| (I)-5 | 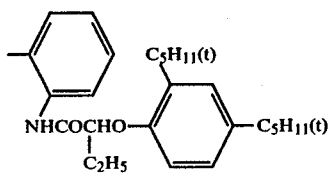 | 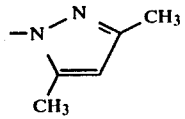 | CN | Cl |
| (I)-6 | 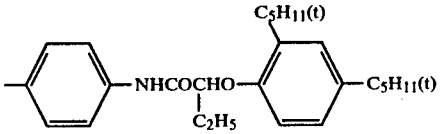 | 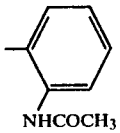 | CN | Cl |
| (I)-7 | 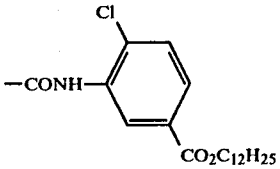 | 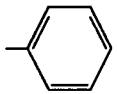 | 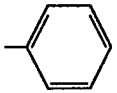 | Cl |
| (I)-8 | $-CO_2C_2H_5$ | 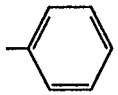 | 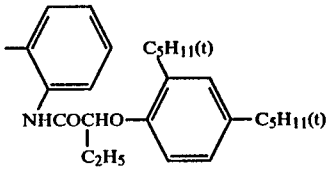 | Cl |
| (I)-9 | $-CN$ | 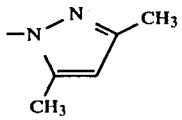 | 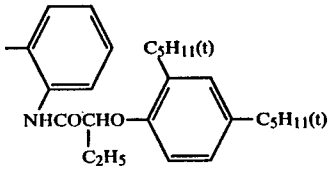 | Cl |

-continued
| | $R^1$ | $R^2$ | $R^3$ | X |
|---|---|---|---|---|
| (I)-10 | —CN | 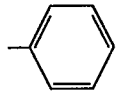 | 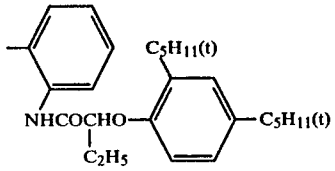 | Cl |
| (I)-11 | $-CF_3$ | 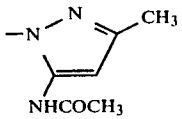 | 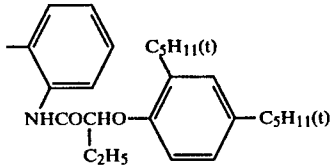 | Cl |
| (I)-12 | $-CO_2CH_2CH_2SO_2$ 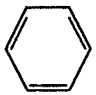 | 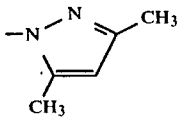 | 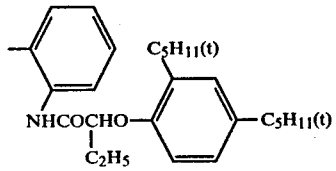 | Cl |
| (I)-13 | $CF_3$ | 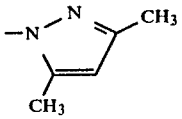 | 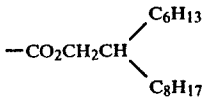 | Cl |
| (I)-14 | $CF_3$ | 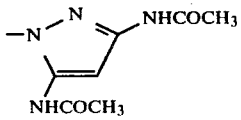 | 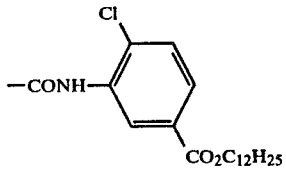 | Cl |
| (I)-15 | $CF_3$ | 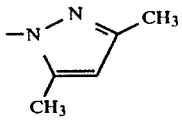 | 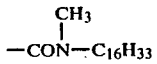 | Cl |

-continued
| | $R^1$ | $R^2$ | $R^3$ | X |
|---|---|---|---|---|
| (I)-16 | 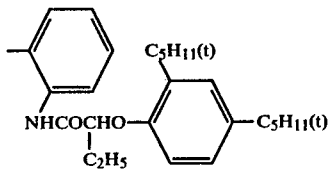 | 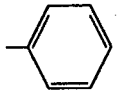 | —CN | 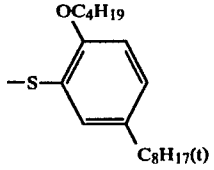 |
| (I)-17 | $CF_3$ | 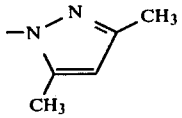 | 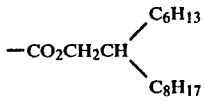 | $-SCH_2CH_2OH$ |
| (I)-18 | $CF_3$ | 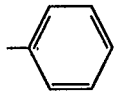 | 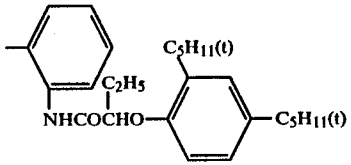 | 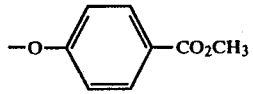 |
| (I)-19 | —CN | 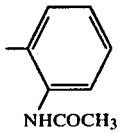 | 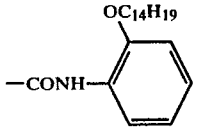 | 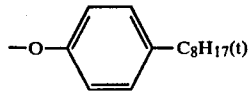 |
| (I)-20 | —CN | 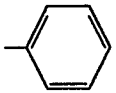 | $-SO_2NHC_{18}H_{37}$ | $-OCOCH_3$ |
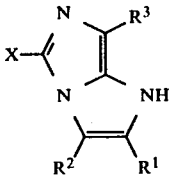
(II)

-continued
| | $R^1$ | $R^2$ | $R^3$ | X |
|---|---|---|---|---|
| (II)-1 | 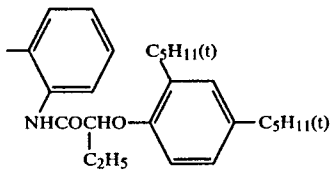 | $-CH_3$ | $-CN$ | H |
| (II)-2 | 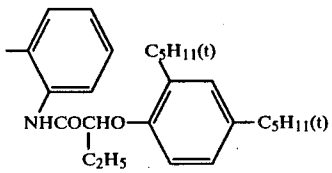 | $-CH_3$ | $-CN$ | Cl |
| (II)-3 | 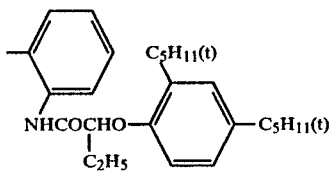 | $-CONH-$ 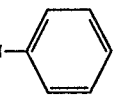 | $-CN$ | Cl |
| (II)-4 | 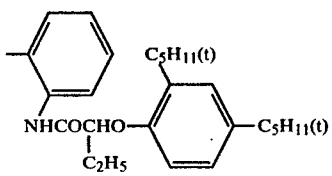 | $-CN$ | $-CN$ | Cl |
| (II)-5 | 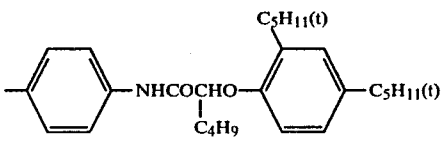 | $CH_3$ | $-CO_2C_2H_5$ | Cl |

-continued
| | $R^1$ | $R^2$ | $R^3$ | X |
|---|---|---|---|---|
| (II)-6 | 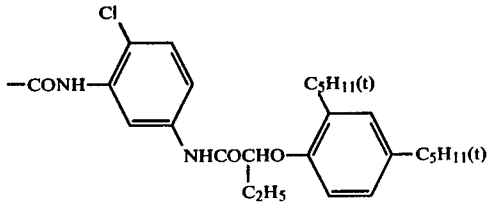 | $CH_3$ | CN | H |
| (II)-7 | 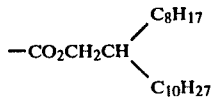 | $CH_3$ | CN | H |
| (II)-8 | —CN | —$NHCOC_{15}H_{31}$ | CN | H |
| (II)-9 | —CN | 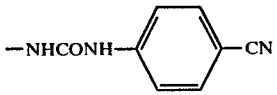 | 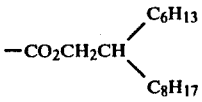 | H |
| (II)-10 | —CN | 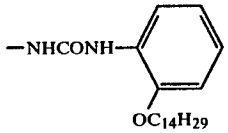 | —$CO_2C_2H_5$ | Cl |
| (II)-11 | —CN | 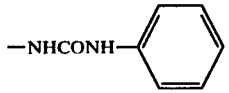 | —$CO_2C_{16}H_{33}$ | Cl |
| (II)-12 | $CF_3$ | —$CH_3$ | —$CO_2C_{16}H_{33}$ | Cl |
| (II)-13 | 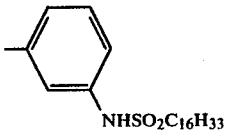 | $CH_3$ | CN | 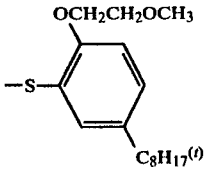 |

-continued
| | $R^1$ | $R^2$ | $R^3$ | X |
|---|---|---|---|---|
| (II)-14 | 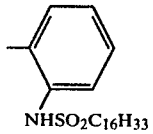 | $CH_3$ | CN | 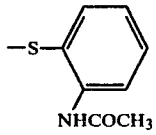 |
| (II)-15 | 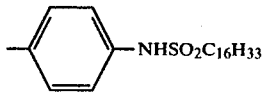 | $CH_3$ | CN | 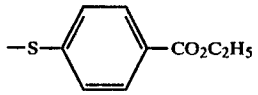 |
| (II)-16 | 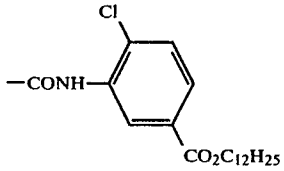 | $CH_3$ | CN | 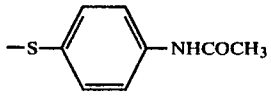 |
| (II)-17 | —CN | $-NHSO_2C_{16}H_{33}$ | CN | 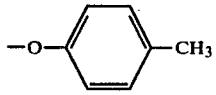 |
| (II)-18 | —CN | 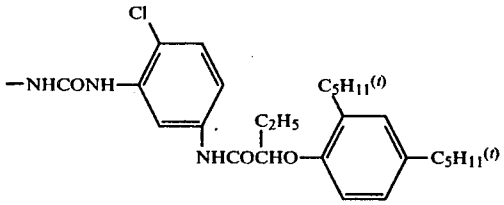 | CN | 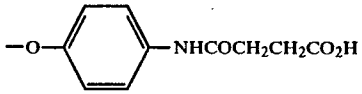 |
| (II)-19 | —CN | 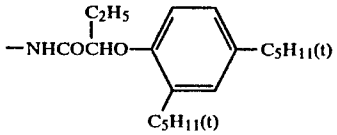 | CN | $-OCH_2CH_2OH$ |
| (II)-20 | —CN | $-NCOC_4H_9$ (CH$_3$) | $-CO_2C_{12}H_{25}$ | $-SCH_2CO_2H$ |

-continued
| | $R^1$ | $R^2$ | $R^3$ | X |
|---|---|---|---|---|
| | | 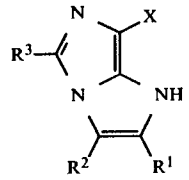 | | (III) |
| (III)-1 | 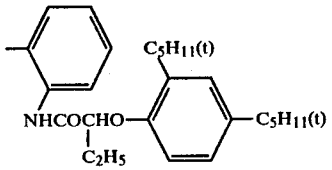 | —CONH— 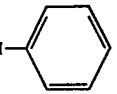 | —$CH_3$ | H |
| (III)-2 | 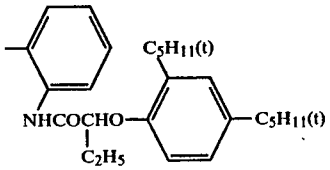 | —CONH— 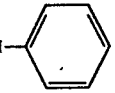 | 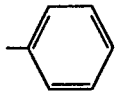 | Cl |
| (III)-3 | 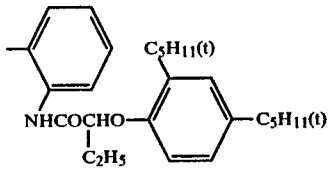 | —CONH— 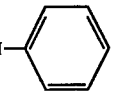 | 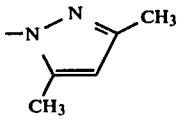 | Cl |
| (III)-4 | 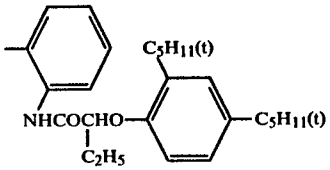 | —CN | 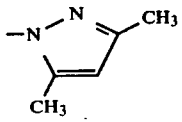 | Cl |

-continued
| | $R^1$ | $R^2$ | $R^3$ | X |
|---|---|---|---|---|
| (III)-5 | 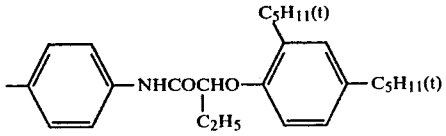 | —CN | 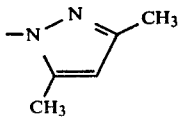 | Cl |
| (III)-6 | 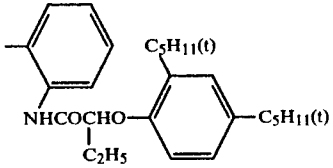 | —CN | 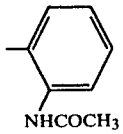 | Cl |
| (III)-7 | 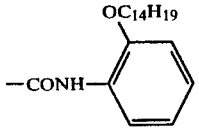 | —$CH_3$ | 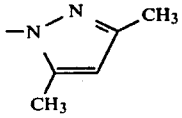 | Cl |
| (III)-8 | 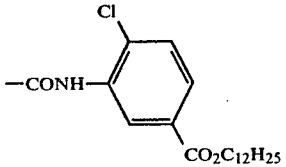 | —$CH_3$ | 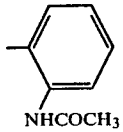 | Cl |
| (III)-9 | —$CONH(CH_2)_3OC_{12}H_{25}$ | —$CH_3$ | 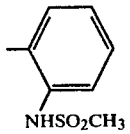 | Cl |
| (III)-10 | 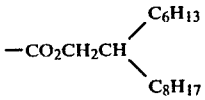 | —$CH_3$ | 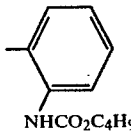 | Cl |

-continued
| | $R^1$ | $R^2$ | $R^3$ | X |
|---|---|---|---|---|
| (III)-11 | $-CO_2CH_2CH_2(CF_2)_6F$ | $-CH_3$ | 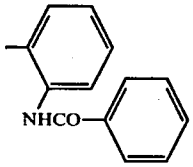 | Cl |
| (III)-12 | $-CO_2CH_2CH(C_6H_{13})(C_8H_{17})$ | $-CH_3$ | 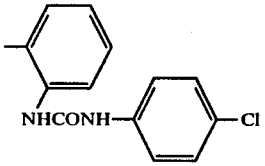 | Cl |
| (III)-13 | $-CN$ | 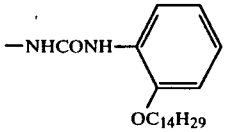 | 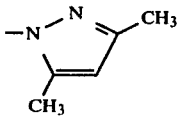 | Cl |
| (III)-14 | $-CN$ | $-NHSO_2C_{16}H_{33}$ | 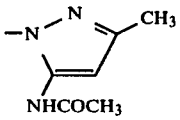 | Cl |
| (III)-15 | $-CN$ | 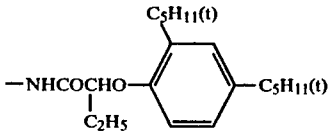 | 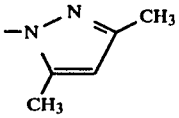 | Cl |
| (III)-16 | 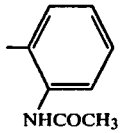 | 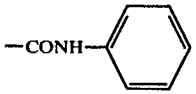 | 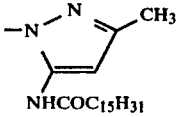 | 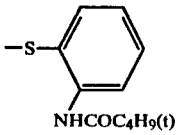 |

-continued

| | $R^1$ | $R^2$ | $R^3$ | X |
|---|---|---|---|---|
| (III)-17 | $-CO_2CH_2CH(C_6H_{13})(C_8H_{17})$ | $-CH_3$ | $-C_6H_4-NHCOCH_3$ | $-S-C_6H_4-NHCO_2CH_3$ |
| (III)-18 | $-CN$ | $-NHCOCH(C_4H_9)-C_6H_3(C_5H_{11}(t))-C_5H_{11}(t)$ | $-N(N=C(CH_3)-CH_3)$ | $-S-C_6H_3(OC_4H_9)-C_8H_{17}(t)$ |
| (III)-19 | $-C_6H_4-NHCOCH(C_2H_5)-C_6H_3(C_5H_{11}(t))-C_5H_{11}(t)$ | $-CN$ | $-C_6H_4-NHCO-C_6H_5$ | $-O-C_6H_4-OC_4H_9$ |
| (III)-20 | $-C_6H_4-NHCOCH(C_3H_7(i))-C_6H_3(C_5H_{11}(t))-C_5H_{11}(t)$ | $-CONH-C_6H_5$ | $-C_6H_5$ | $-OCH_2CH_2OH$ |

Next, a synthesis example of a representative coupler will be shown.

The synthesis of a 1H-imidazo[1,5-a]imidazole skeleton can be achieved by the condensation reaction of an aminoimidazole derivative (the compound a) with an α-haloketone derivative (the compound b) as shown below:

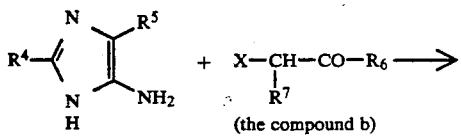

(the compound a) (the compound b)

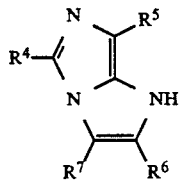

SYNTHESIS EXAMPLE 1: SYNTHESIS OF COUPLER (II)-1

There were dispersed in ethanol (200 ml), 4-amino-5-cyanoimidazole (manufactured by Nippon Soda Co., Ltd.) (5.4 g), 2-bromo-2'-(2,4-di-t-amylphenoxybutanoylamino)propiophenone (27.0 g), and sodium carbonate (10.6 g), and the dispersion was heated at refluxing for 1 hour. After cooling down, ethyl acetate was added and the solution was washed with water. Then, the oily product obtained by distilling the solvent off is refined by column chromatography to thereby obtain Coupler (II)-1 (11.4 g).

The other coupler compounds of the present invention can be synthesized as well in the similar manner.

The light-sensitive material of the present invention may have at least one layer containing the cyan coupler of the present invention on a support, and the layer containing the cyan coupler of the present invention may be a hydrophilic colloidal layer provided on the support. In general, the light-sensitive material can be of the constitution in which at least one blue-sensitive silver halide emulsion layer, at least one green-sensitive silver halide emulsion layer, and at least one red-sensitive silver halide emulsion layer are provided in this order on the support, and the order may be different from this. Further, at least one of the above light-sensitive emulsion layers can be replaced with an infrared-sensitive silver halide emulsion layer. Silver halide emulsions having sensitivities in the respective wavelength regions and color couplers capable of forming the dyes each having a complementary color relationship with sensitizing light can be incorporated into these light-sensitive emulsion layers, whereby a color reproduction by a subtractive method can be carried out. The light-sensitive material can have a constitution in which the light-sensitive emulsion layer and the hue of the developed color of the color coupler have no such the correspondence each other as described above.

Where the cyan coupler of the present invention is applied to a light-sensitive material, it is used particularly preferably in a red-sensitive silver halide emulsion layer.

The amount of the cyan coupler of the present invention in the light-sensitive material is suitably $1\times10^{-3}$ to 1 mole, preferably $2\times10^{-3}$ to $3\times10^{-1}$ mole, per mole of silver halide.

A photosensitive material containing a cyan coupler of the present invention forms a cyan image having excellent color hue, when the photosensitive material is developed with a color developing solution containing a color developing agent. A maximum absorption wavelength (λmax) of the formed image is 580 to 720 nm, preferably 600 to 700 nm, more preferably 620 to 650 nm.

The couplers of the present invention can be incorporated into a light-sensitive material by various conventional methods. Preferred is an oil-in-water dispersion method in which they are dissolved in a high boiling solvent (a low boiling solvent is used in combination according to necessity) and are emulsified and dispersed in a gelatin aqueous solution, to add to a silver halide emulsion.

Examples of the high boiling solvent used in the oil-in-water dispersion method are described in U.S. Pat. No. 2,322,027.

There can be enumerated as the high boiling organic solvent which can be used in the above oil-in-water dispersion method, phthalic acid esters (for example, dibutyl phthalate, dioctyl phthalate, dicyclohexyl phthalate, di-2-ethylhexyl phthalate, decyl phthalate, bis(2,4-di-tert-amylphenyl)isophthalate, and bis(1,1-diethylpropyl)phthalate), phosphoric acid or phosphonic acid esters (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl p-hydroxybenzoate), amides (for example, N,N-diethyl dodecanamide and N,N-diethyl laurylamide), alcohols or phenols (for example, isostearyl alcohol and 2,4-di-tert-amylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), an aniline derivative (for example, N,N-dibutyl-2-butoxy-5-tert-octylaniline), chlorinated paraffin (for example, paraffins having a chlorine content of 10 to 80%), trimesic acid esters (for example, tributyl trimesate), dodecylbenzene, diisopropylnaphthalene, phenols (for example, 2,4-di-tert-amylphenol, 4-dodecyloxyphenol, 4-dodecyloxycarbonylphenol, and 4-(4-dodecyloxyphenylsulfonyl)-phenol), carboxylic acids (for example, 2-(2,4-di-tert-amylphenoxy)butyric acid, and 2-ethoxyoctanedecanoic acid), and alkylphosphoric acids (for example, di-2(ethylhexyl) phosphoric acid and diphenylphosphoric acid). Further, there may be used in combination as an auxiliary solvent, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide).

The high boiling solvents can be used in an amount of 0 to 2.0 times, preferably 0 to 1.0 times the amount of a coupler by weight.

The couplers of the present invention also can be incorporated into a light-sensitive material by a polymer dispersing method, such as a latex dispersing method.

The procedures for and effect of latex dispersing methods as one of the polymer dispersing methods and specific examples of a latex for impregnation are described in U.S. Pat. No. 4,199,363, German Patent Applications (OLS) 2,541,274 and 2,541,230, JP-B-53-41091 (the term "JP-B" as used herein means an examined Japanese patent publication ), and European Patent Publication 029104, and further a dispersion method by an organic solvent-soluble polymer is described in PCT International Patent Publication W088/00723.

In JP-A-62-215272, JP-A-2-33144, JP-A-2-854, JP-A-2-93641, JP-A-3-194539, and JP-A-145433, and European Patent EP 0,355,660A2 there are described silver halide emulsions, other materials (the additives) and photographic constitutional layers (a layer arrangement) which can preferably be used in the present invention, as well as processing methods and additives for processing, which are applied for processing the light-sensitive material, which can preferably be used in the present invention.

In a stabilizing solution for a color negative film, formaldehyde is generally used as a stabilizer. Formaldehyde may be used as the stabilizer in the present invention as conventionally used, but preferred from the viewpoint of a safety in a working environment are N-methylolpyrazole, hexamethylenetetramine, a formaldehyde-bisulfurous acid adduct, dimethylolurea, and a triazole derivative such as 1,4-bis(1,2,4-triazole-1-ylmethyl)piperazine. Among them, preferably used in combination are N-methylolpyrazole obtained by the reaction of formaldehyde with pyrazole, triazole such as 1,2,4-triazole, and the derivative thereof such as 4-bis(1,2,4-triazole-l-ylmethyl )piperazine (Japanese Patent Application 3-159918) because of a high image stability and less vapor pressure of formaldehyde.

In addition, the coupler of the present invention can be applied to a conventional dry type analytical element. In this field, the coupler is called as a color technical product in some cases. Those described in, for example, U.S. Pat. Nos. 3,992,158 and 4,042,335, and JP-A-55-164356 can be enumerated as a multilayered dry type analytical element.

The present invention will be explained below with reference to the examples, but is not limited thereto.

EXAMPLE 1Preparation of Sample 101

An emulsified dispersion (1) of a comparative coupler ( C-1 ) was prepared in the manner described below.

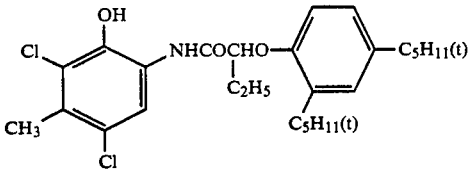

Comparative coupler (C-1)

The comparative coupler (C-1) (1.03 g) and tris (2-ethylhexyl) phosphate (0.9 ml) were added to ethyl acetate (10 ml) and completely dissolved while maintaining the temperature of the resulting solution at about 40° C. This resulting solution is hereafter referred to as "an oil phase liquid".

Independently from this, gelatin (4.2 g) was added to water (26 ml) at room temperature and after allowing the gelatin to sufficiently be swollen, the solution temperature was maintained at about 40° C. to completely dissolve the gelatin. While maintaining this gelatin aqueous solution at about 40° C., a 5% sodium benzenesulfaonate aqueous solution (3 ml) and all of the oil phase liquid previously prepared were added, and the liquid was emulsified and dispersed, whereby an emulsified dispersion (1) was obtained. This emulsified dispersion (1) was used to prepare a coating liquid of the following composition. The coating liquid then was coated on a subbed cellulose triacetate support so that the coated amount of the coupler was 1 mmol/$m^2$. Further, gelatin of 2 g/$m^2$ was coated as a protective layer on this emulsion layer, whereby Sample 101 was prepared.

| Coating liquid | |
|---|---|
| Emulsion (silver chlorobromide, Br: 30 mol %) | 13 g |
| 10% gelatin | 28 g |
| Emulsified dispersion (1) | 22 g |
| Water | 37 ml |
| 4% aqueous solution of sodium 1-oxy-3,5-dichloro-s-triazine | 5 ml |

Preparation of Samples 102 to 116

Samples 102 to 116 were prepared in the same manner as that in Sample 101, except that the comparative coupler (C-1) was replaced with the exemplified couplers shown in Table 1 in the same mole amount.

The samples thus prepared were subjected to a wedge exposure with a white light and then to a color development processing by the following processing procedure (I).

A reduction rate of the image density with respect to those of an unexposed sample is shown in Table 1. From the results in Table 1, it is clear that the sample according to the present invention shows slight lowering in density comparing with the comparative samples.

Next, these samples were irradiated with light in a Xenon test chamber (100,000 lux) for 6 days to carry out a forced test. The standard of image fastness was determined by the density after the test at the portion at which the density was 1.0 before the test.

The results are summarized in Table 1.

| Processing Procedure (I) | | |
|---|---|---|
| Processing step | Temperature | Time |
| Color developing | 35° C. | 3 minutes |
| Bleach-fixing | 30 to 36° C. | 45 seconds |
| Stabilizing (1) | 30 to 37° C. | 20 seconds |
| Stabilizing (2) | 30 to 37° C. | 20 seconds |
| Stabilizing (3) | 30 to 37° C. | 20 seconds |
| Stabilizing (4) | 30 to 37° C. | 20 seconds |
| Drying | 70 to 85° C. | 60 seconds |

(A four tank countercurrent system from Stabilizations (4) to (1) was employed).

The compositions of the respective processing solutions are as follows:

| Color developing solution | |
|---|---|
| Water | 800 ml |
| Ethylenediaminetetraacetic acid | 2.0 g |
| Triethanolamine | 8.0 g |
| Sodium chloride | 1.4 g |
| Potassium bromide | 0.6 g |
| Potassium carbonate | 25 g |
| N-ethyl-N-(β-methanesulfonamidethyl)-3-methyl-4-aminoaniline sulfate | 5.0 g |
| 5,6-Dihydroxybenzene-1,2,4-trisulfonic acid | 0.3 g |
| N,N-diethylhydroxylamine | 4.2 g |

-continued

| | |
|---|---|
| Fluorescent whitening agent (4,4'-diaminostilbene series) | 2.0 g |
| Water was added to | 1000 ml |
| pH (25° C.) | 10.25 |
| Bleach-fixing solution | |
| Water | 400 ml |
| Ammonium thiosulfate (700 g/liter) | 100 ml |
| Sodium sulfite | 18 g |
| Iron (III) ammonium ethylenediaminetetraacetate | 55 g |
| Disodium ethylenediaminetetraacetate | 3 g |
| Glacial acetic acid | 8 g |
| Water was added to | 1000 ml |
| pH (25° C.) | 5.5 |
| Stabilizing solution | |
| Formalin (37%) | 0.1 g |
| Formalin-sulfurous acid adduct | 0.7 g |
| 5-Chloro-2-methyl-4-isothiazline-3-on | 0.02 g |
| 2-Methyl-4-isothiazline-3-one | 0.01 g |
| Copper sulfate | 0.005 g |
| Water was added to | 1000 ml |
| pH (25° C.) | 4.0 |

TABLE 1

| Sample | Coupler | Light fastness (6 days; %) | Remarks |
|---|---|---|---|
| 101 | C-1 | 21 | Comparison |
| 102 | (I)-2 | 6 | Invention |
| 103 | (I)-4 | 5 | " |
| 104 | (I)-5 | 7 | " |
| 105 | (I)-6 | 4 | " |
| 106 | (I)-10 | 4 | " |
| 107 | (II)-1 | 9 | " |
| 108 | (II)-4 | 7 | " |
| 109 | (II)-8 | 10 | " |
| 110 | (II)-9 | 9 | " |
| 111 | (II)-12 | 12 | " |
| 112 | (III)-1 | 10 | " |
| 113 | (III)-4 | 6 | " |
| 114 | (III)-8 | 9 | " |
| 115 | (III)-11 | 8 | " |
| 116 | (III)-15 | 7 | " |

As apparent from the results shown in Table 1, it can be found that the couplers of the present invention provide excellent light fastness.

EXAMPLE 2

Sodium carbonate (3.75 g), the developing agent R (0.81 g) and ammonium persulfate (1.65 g) were added in order to a solution of comparative coupler (C-1) (same as in Example 1) (2.6 millimole), chloroform (65 ml) and distilled water (50 ml) at room temperature. Further, stirring was applied for 1 hour and then the aqueous layer was discarded. The chloroform layer was concentrated and refined by silica gel column chromatography, whereby the following azomethine comparative dye (D-1) was obtained. Further, comparative coupler (C-1) was replaced with the couplers of the present invention, whereby several kinds of dyes were similarly prepared.

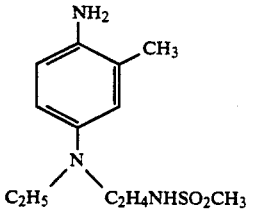

Developing agent R

-continued

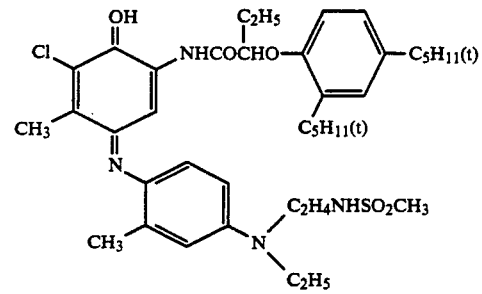

(D-1)

The comparative dye (D-1) (2 mg) was measured and put in a 100 ml measuring flask, and ethyl acetate was added to dissolve it at a room temperature. Then, ethyl acetate was added to a level line. After calmly shaking to uniformize the solution, it was put in a cell having a thickness of 1 cm to measure a visible spectrum with a spectrophotometer for UV and visible region, manufactured by Shimazu Mfg. Co., Ltd.

The three items of ΔW1/2, Δλ and Abs (B) shown in the sole figure of the drawing were evaluated as the standards for showing the absorption characteristics of the dyes.

In the figure, ΔW1/2 shows a half band width of a main absorption. Generally, the smaller the ΔW1/2 value, the more sharp in absorption, thereby obtaining a clear cyan colored image with minimum red density.

Δλ show a position of a second absorption with respect to a main absorption, which is caused at a certain short wavelength side.

Abs (B) shows a magnitude of a second absorption zone, which is Abs of the second absorption zone provided that a Abs of the main absorption is defined as 1.

In a cyan dye, when Δλ is large, and Abs (B) is small, a clear cyan colored image is obtained. The smaller the ΔW1/2 is, the larger the Δλ is and the smaller the Abs (B) is, the more preferable absorption characteristics they are in terms of a color reproduction.

TABLE 2

| Coupler No. | ΔW1/2 (nm) | Δλ (nm) | Abs. (B) | Remarks |
|---|---|---|---|---|
| C-1 (Dye: D-1) | 118 | 270 | 0.29 | Comparison |
| (I)-2 | 110 | 290 | 0.20 | Invention |
| (I)-15 | 107 | 288 | 0.19 | " |
| (II)-1 | 106 | 300 | 0.19 | " |
| (II)-8 | 104 | 302 | 0.18 | " |
| (III)-1 | 102 | 298 | 0.12 | " |
| (III)-3 | 103 | 297 | 0.10 | " |

As shown in the results summarized in Table 2, it can be seen that the cyan dyes obtained from the cyan couplers of the present invention have more excellent absorption characteristics than that of the cyan dye obtained from the comparative coupler.

EXAMPLE 3

A paper support laminated on both sides thereof with polyethylene, which was subjected to a corona discharge treatment, was provided with a gelatin subbing layer containing sodium dodecylbenzenesulfonate, and further was coated with various photographic constitutional layers, whereby a multilayered color photographic paper (Sample 301) having the following layer constitution was prepared. The coating solutions were prepared in the following manner.

Preparation of the Fifth Layer Coating Solution

Ethyl acetate (60.0 ml) was added to a cyan coupler (ExC) (20.0 g), UV absorber (UV-2) (2.0 g), dye image stabilizer (Cpd-1) (10.0 g), dye image stabilizer (Cpd-3) (5.0 g), dye image stabilizer (Cpd-5) (10.0 g), dye image stabilizer (Cpd-6 ) (2.0 g), dye image stabilizer (Cpd-8) (10.0 g), solvent (Solv-3) (40.0 g), and solvent (Solv-5 ) (20.0 g) to dissolve them. This solution was added to a 20% gelatin aqueous solution (500 ml) containing sodium dodecylbenzenesulfonate (8.0 g) and then was emulsified and dispersed with a supersonic homogenizer, whereby an emulsified dispersion C was prepared.

Meanwhile, there was prepared a silver bromochloride Emulsion C (cube, a 1:4 mixture (Ag mole ratio) of a large size emulsion C with an average grain size of 0.50 μm and a small size emulsion C with an average grain size of 0.41 μm, wherein the variation coefficients in the grain size distributions were 0.09 and 0.11, respectively, and both size emulsions contained grains in which silver bromide 0.8 mol % was localized on a part of the grain surface). In the Emulsion C, a red-sensitive sensitizing dye E was added to the large size emulsion C in an amount of $0.9\times10^{-4}$ mole per mole of silver and to the small size emulsion C in an amount of $1.1\times10^{-4}$ per mole of silver, respectively. Further, a compound F was added in an amount of $2.6\times10^{-3}$ mole per mole of silver. The Emulsion C was subjected to a chemical ripening by adding a sulfur sensitizer and a gold sensitizer. The above emulsified dispersion and the red-sensitive silver bromochloride Emulsion C were mixed and dissolved to prepare a fifth layer coating solution so that it was of the composition shown below.

The coating solutions for the first layer to fourth layer, sixth layer and seventh layer were prepared in the same manner as that for the fifth layer coating solution. Sodium 1-oxy-3,5-dichloro-s-triazine was used as the gelatin hardener for the respective layers.

Further, Cpd-14 and Cpd-15 were added to the respective layers so that the whole amounts thereof became 25.0 mg/m$^2$ and 50.0 mg/m$^2$, respectively.

The spectral sensitizing dyes used for the silver bromochloride emulsions contained in the respective light-sensitive emulsion layers are shown below:

Blue-sensitive Emulsion Layer

Sensitizing dye A

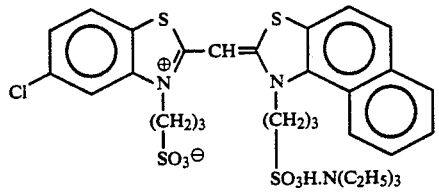

and

Sensitizing dye B

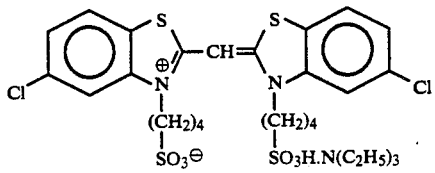

(each $2.0\times10^{-4}$ mole per mole of silver halide to the large size emulsion A and each $2.5\times10^{-4}$ mole per mole of silver halide to the small size emulsion A)

Green-sensitive Emulsion Layer

Sensitizing dye C

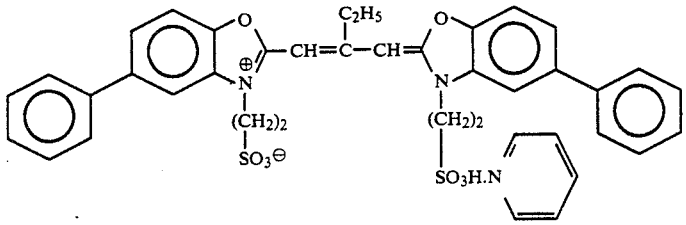

($4.0\times10^{-4}$ mole per mole of silver halide to a large size emulsion B and $5.6\times10^{-4}$ mole per mole of silver halide to a small size emulsion B)

Sensitizing dye D

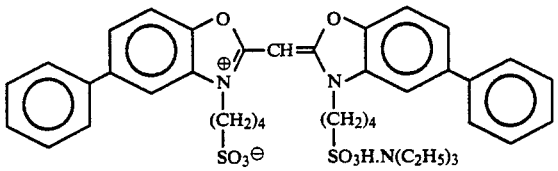

($7.0\times10^{-5}$ mole per mole of silver halide to the large size emulsion B and $10.0\times10^{-5}$ mole per mole of silver halide to the small size emulsion B).

Red-sensitive emulsion layer

Sensitizing dye E

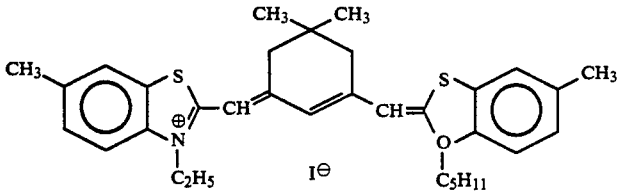

Compound F

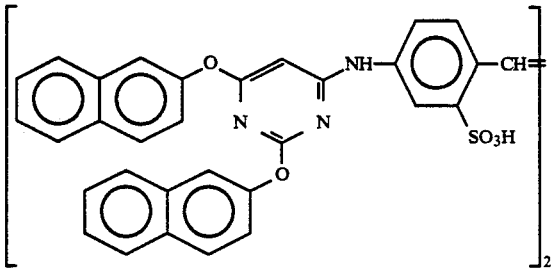

Further, 1-(5-methylureidophenyl)-5-mercaptotetrazole was added to the blue-sensitive emulsion layer, green-sensitive emulsion layer and red-sensitive emulsion layer in the amounts of $8.5\times10^{-5}$ mole, $7.7\times10^{-4}$ mole and $2.5\times10^{-4}$ mole per mole of silver halide, respectively.

Further, 4-hydroxy-6-methyl-1,3,3a, 7-tetraazaindene was added to the blue-sensitive emulsion layer and green-sensitive emulsion layer in the amounts of $1\times10^{-4}$ mole and $2\times10^{-4}$ mole per mole of silver halide, respectively.

Further, the following dyes (the numeral in the parenthesis represents a coated amount) was added to the emulsion layers to prevent irradiation:

First Layer (Blue-sensitive Emulsion Layer)

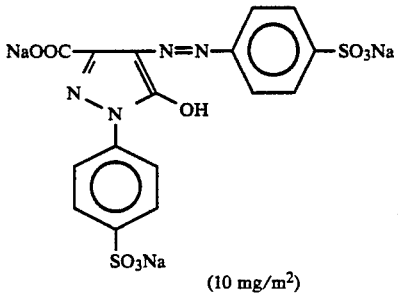

(10 mg/m²)

Third Layer (Green-sensitive Emulsion Layer)

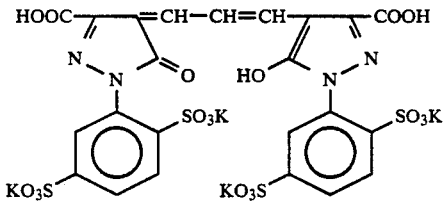

(10 mg/m²)

Fifth Layer (Red-sensitive Emulsion Layer)

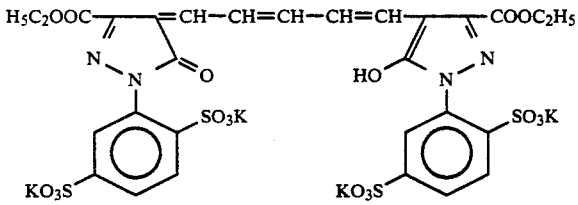

(40 mg/m²)

and

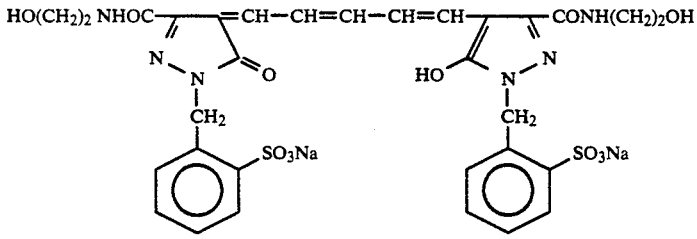

(20 mg/m²)

Layer Constitution

The compositions of the respective layers are shown below. The numerals represent the coated amounts ($g/m^2$). The coated amounts of the silver halide emulsions are shown in terms of the amounts converted to silver.

Support

Polyethylene laminated paper (polyethylene coated on the 1st layer side contains a white pigment (titanium dioxide) and a blue dye (ultramarine)).

| | |
|---|---|
| First layer (a blue-sensitive emulsion layer): | |
| Silver bromochloride emulsion (cube, 3:7 mixture (Ag mole ratio) of a large size emulsion A having an average grain size of 0.88 μm and a small size emulsion A having an average grain size of 0.70 μm, wherein the variation coefficients in the grain size distributions were 0.08 and 0.10, respectively, and both size emulsions comprised grains in which silver bromide 0.3 mol % was localized on a part of the grain surface) | 0.27 |
| Gelatin | 1.36 |
| Yellow coupler (ExY) | 0.60 |
| Dye image stablizer (Cpd-1) | 0.06 |
| Dye image stablizer (Cpd-2) | 0.03 |
| Dye image stablizer (Cpd-3) | 0.06 |
| Solvent (Solv-1) | 0.10 |
| Solvent (Solv-2) | 0.10 |
| Second layer (an anti-color mixing layer): | |
| Gelatin | 1.00 |
| Anti-color mixing agent (Cpd-4) | 0.07 |
| Solvent (Solv-7) | 0.03 |
| Solvent (Solv-2) | 0.25 |
| Solvent (Solv-3) | 0.25 |
| Third layer (a green-sensitive emulsion layer): | |
| Silver bromochloride emulsion (cube, 1:3 mixture (Ag mole ratio) of a large size emulsion B having an average grain size of 0.55 μm and a small size emulsion B having an average grain size of 0.39 μm, wherein the variation coefficients in the grain size distributions were 0.10 and 0.08, respectively, and both size emulsions comprised grains in which silver bromide 0.8 mol % was localized on a part of the grain surface) | 0.13 |
| Gelatin | 1.45 |
| Magenta coupler (ExM) | 0.16 |
| Dye image stablizer (Cpd-5) | 0.15 |
| Dye image stablizer (Cpd-2) | 0.03 |
| Dye image stablizer (Cpd-6) | 0.01 |
| Dye image stablizer (Cpd-7) | 0.01 |
| Dye image stablizer (Cpd-8) | 0.08 |
| Solvent (Solv-3) | 0.50 |
| Solvent (Solv-4) | 0.15 |
| Solvent (Solv-5) | 0.15 |
| Fourth layer (an anti-color mixing layer): | |
| Gelatin | 0.70 |
| Anti-color mixing agent (Cpd-4) | 0.05 |
| Solvent (Solv-7) | 0.02 |
| Solvent (Solv-2) | 0.18 |
| Solvent (Solv-3) | 0.18 |
| Fifth layer (a red-sensitive emulsion layer): | |
| Above silver bromochloride emulsion C | 0.14 |
| Gelatin | 1.10 |
| Cyan Coupler (ExC) | 0.20 |
| UV absorber (UV-2) | 0.02 |
| Dye image stabilizer (Cpd-1) | 0.10 |
| Dye image stabilizer (Cpd-3) | 0.05 |
| Dye image stabilizer (Cpd-5) | 0.10 |
| Dye image stabilizer (Cpd-6) | 0.02 |
| Dye image stabilizer (Cpd-8) | 0.10 |
| Solvent (Solv-3) | 0.40 |

-continued

| | |
|---|---|
| Solvent (Solv-5) | 0.20 |
| Sixth layer (a UV absorbing layer): | |
| Gelatin | 0.55 |
| UV absorber (UV-1) | 0.40 |
| Dye image stabilizer (Cpd-12) | 0.15 |
| Dye image stabilizer (Cpd-5) | 0.02 |
| Seventh layer (a protective layer): | |
| Gelatin | 1.13 |
| Acryl-modified copolymer of polyvinyl alcohol (a modification degree: 17%) | 0.05 |
| Liquid paraffin | 0.02 |
| Dye image stabilizer (Cpd-5) | 0.01 |

(ExY) Yellow coupler
1:1 mixture (mole ratio) of

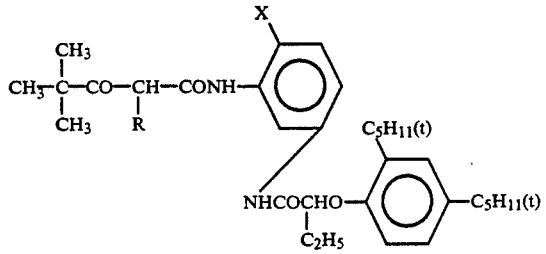

R = 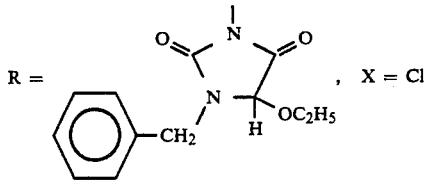 , X = Cl and

R = 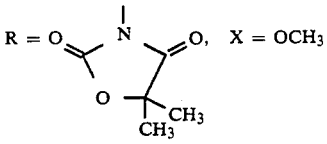 , X = $OCH_3$ (ExM) Magenta coupler

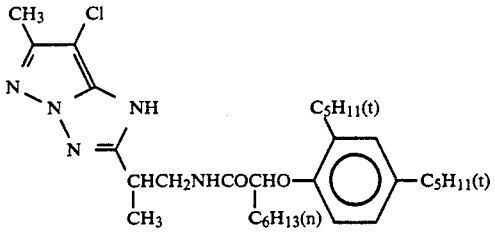

(ExC) Cyan coupler
3:7 mixture (mole ratio) of

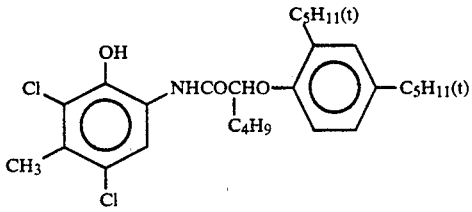

and

-continued

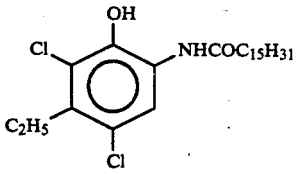

(Cpd-1) Dye image stabilizer

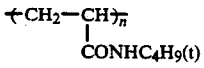

(Average molecular weight: 60,000)
(Cpd-2) Dye image stabilizer

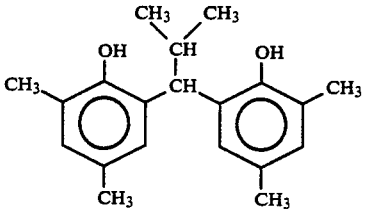

(Cpd-3) Dye image stabilizer

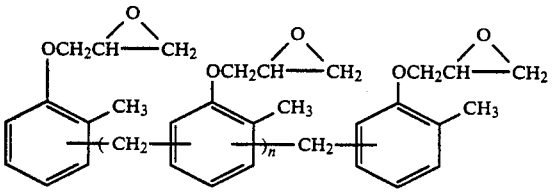

n = 7 to 8 (average value)
(Cpd-4) Anti-color mixing agent

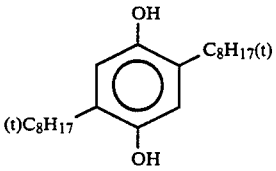

(Cpd-5) Dye image stabilizer

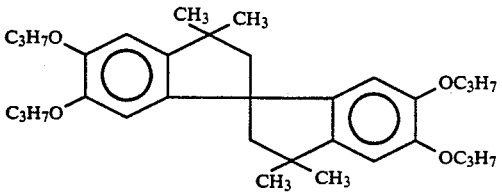

(Cpd-6) Dye image stabilizer

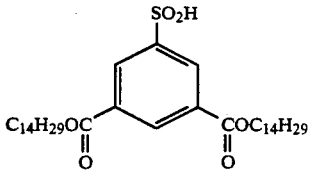

(Cpd-7) Dye image stabilizer

-continued

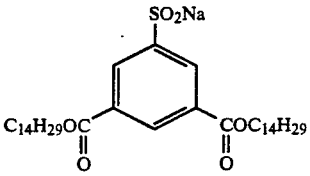

(Cpd-8) Dye image stabilizer

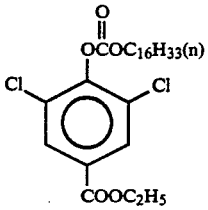

(Cpd-12)

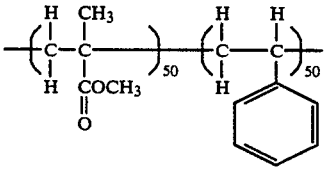

Average molecular weight: 60,000
(Cpd-14) Preservative

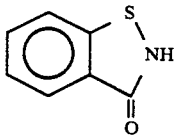

(Cpd-15) Preservative

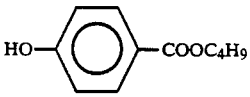

(UV-1) UV absorber
1:5:10:5 mixture (weight ratio) of

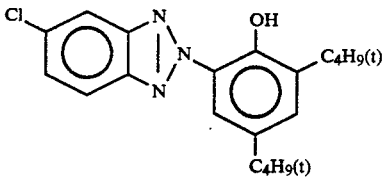

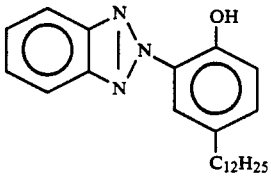

-continued

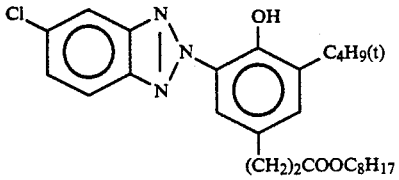

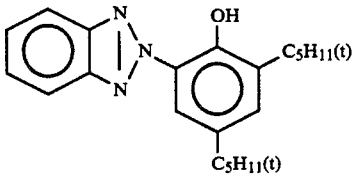

(UV-2) UV absorber
1:2:2 mixture (weight ratio) of

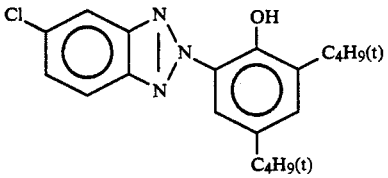

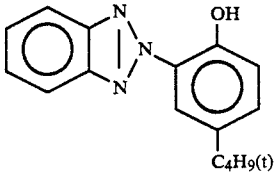

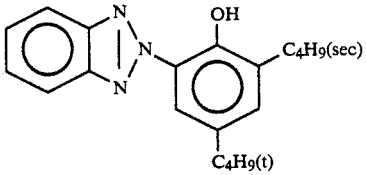

(Solv-1) Solvent

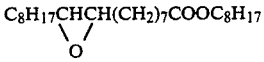

(Solv-2) Solvent

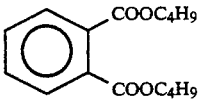

(Solv-3) Solvent

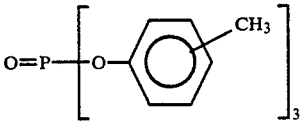

(Solv-4) Solvent

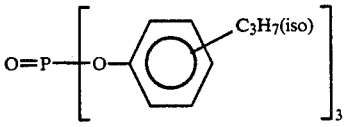

(Solv-5) Solvent

-continued

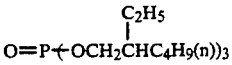

(Solv-6) Solvent

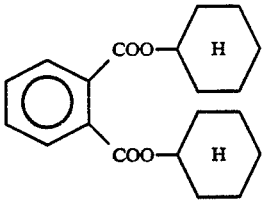

(Solv-7) Solvent

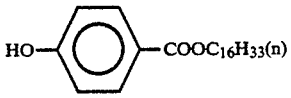

Preparation of Samples 302 to 316

Samples 302 to 316 were prepared in the same manner as that in Sample 301, except that the cyan coupler (ExC) was replaced with the cyan couplers of the present invention used in Example 1 in the same mole amount.

First, each sample was subjected to an exposure according to the method described in Example 1 (provided that the exposure was provided with a red light). The sample thus exposed was subjected to a continuous processing with a paper processing machine at the following steps in the following processing solutions to create a development processing condition in a running equilibrium status.

After this running test was finished, Samples 301 to 316 were subjected to an evaluation of color development and image fastness in the same manner as that in Example 1 to find that the samples of the present invention provided excellent image fastness.

| Processing step | Temperature | Time | Replenishing amount* | Tank capacity |
|---|---|---|---|---|
| Color developing | 35° C. | 45 seconds | 161 ml | 17 l |
| Bleach/fixing | 30 to 35° C. | 45 seconds | 215 ml | 17 l |
| Rinsing | 30° C. | 90 seconds | 350 ml | 10 l |
| Drying | 70 to 80° C. | 60 seconds | | |

*Replenishing amount: per $m^2$ of the light-sensitive material.

The compositions of the respective processing solutions are as follows:

| | Tank Solution | Replenishing solution |
|---|---|---|
| Color developing solution | | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidethyl)-3-methyl-4-aminoaniline sulfate | 5.0 g | 7.0 g |
| N,N-bis(carboxymethyl)- | 4.0 g | 5.0 g |

-continued

| | | |
|---|---|---|
| hydrazine | | |
| Monosodium N,N-di(sulfoethyl)-hydroxylamine | 4.0 g | 5.0 g |
| Fluorescent whitening agent (Whitex 4B manufactured by Sumitomo Chem. Ind. Co., Ltd.)) | 1.0 g | 2.0 g |
| Water was added to | 1000 ml | 1000 ml |
| pH (25° C.) | 10.05 | 10.45 |
| Bleach/fixing solution (Common to the tank solution and replenishing solution) | | |
| Water | 400 ml | |
| Ammonium thiosulfate (700 g/liter) | 100 ml | |
| Sodium sulfite | 17 g | |
| Iron (III) ammonium ethylenediaminetetracetate | 55 g | |
| Disodium ethylenediamine-tetracetate | 5 g | |
| Ammonium bromide | 40 g | |
| Water was added to | 1000 ml | |
| pH (25° C.) | 6.0 | |
| Rinsing solution (Common to the tank solution and replenishing solution) | | |
| Deionized water | (contents of calcium and magnesium: each 3 ppm or less) | |

The results of the light fastness are shown in Table 3 below.

TABLE 3

| Sample | Coupler | Light fastness (6 days; %) | Remarks |
|---|---|---|---|
| 301 | C-1 | 7 | Comparison |
| 302 | (I)-2 | 3 | Invention |
| 303 | (I)-4 | 3 | " |
| 304 | (I)-5 | 2 | " |
| 305 | (I)-6 | 2 | " |
| 306 | (I)-10 | 2 | " |

While the invention has been described in detail and with reference to specific embodiments thereof, it will be apparent to one skilled in the art that various changes and modifications can be made therein without departing from the spirit and scope thereof.

What is claimed is:

1. A silver halide color photographic material containing at least one 1H-imidazo[1,5-a ]imidazole cyan coupler represented by the following Formula (I) in at least one red-sensitive silver halide emulsion layer provided on a support:

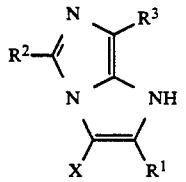

(I)

wherein $R^1$ represents a hydrogen atom or a substituent; $R^2$ and $R^3$ each represent a substituent, provided that at least one of $R^1$, $R^2$ and $R^3$ represents an electron attractive group; and X represents a hydrogen atom or a group capable of splitting off upon a reaction with an oxidation product of a color developing agent.

2. The silver halide color photographic material according to claim 1, wherein each substituent represented by $R_1$, $R_2$ and $R_3$ is selected from an aryl group, an alkyl group, a cyano group, an acyl group, a carbamoyl group, an alkoxycarbonyl group, an aryloxycarbonyl group, a formylamino group, an acylamino group, an alkoxycarbonylamino group, an aryloxycarbonylamino group, a sulfonamido group, a ureido group, a sulfamoylamino group, an alkylamino group, an arylamino group, an alkoxy group, an aryloxy group, a heterocyclic oxy group, an alkylthio group, an arylthio group, a heretocyclic thio group, a heterocyclic group, a halogen atom, a hydroxy group, a nitro group, a sulfamoyl group, a sulfonyl group, an acyloxy group, a carbamoyloxy group, an imido group, a sulfinyl group, a phosphoryl group, a carboxyl group, a phosphono group, and an unsubstituted amino group.

3. The silver halide color photographic material according to claim 1, wherein the electron attractive group represents a cyano group, a nitro group, a carboxyl group, a perfluoroalkyl group, an acyl group, a formyl group, a sulfonyl group, a sulfinyl group, a carbamoyl group, an alkoxycarbonyl group, an aryloxycarbonyl group, a heterocyclic group, an alkylsulfonyloxy group, a phosphonyl group, a sulfamoyl group, a pentachlorophenyl group, a pentafluorophenyl group, and a sulfonyl group-substituted aromatic group.

4. The silver halide color photographic material according to claim 1, wherein the electron attractive group has a Hammett's substituent constant $\sigma_p$ value of 0.3 or more.

5. The silver halide color photographic material according to claim 4, wherein the electron attractive group having a Hammett's substituent constant $\sigma_p$ value of 0.3 or more is selected from a cyano group, a nitro group, an acyl group, a carbamoyl group, a phosphono group, an alkoxycarbonyl group, a phosphoryl group, a sulfamoyl group, a sulfonyl group, and a perfluoroalkyl group.

6. The silver halide color photographic material according to claim 1, wherein X represents a hydrogen atom, a halogen atom, an alkoxy group, an aryloxy group, an acyloxy group, a sulfonyloxy group, an acylamino group, a sulfonamido group, an alkoxycarbonyloxy group, an aryloxycarbonyloxy group, an alkylthio group, an arylthio group, a heterocyclic thio group, a carbamoylamino group, a 5- or 6-membered nitrogen-containing heterocyclic group, an imido group, an aromatic azo group, a sulfinyl group, and a sulfonyl group.

7. The silver halide color photographic material according to claim 1, wherein the cyan coupler is present in an amount of $1\times10^{-3}$ to 1 mole per mole of silver halide.

8. The silver halide color photographic material according to claim 1, wherein $R^1$ represents an electron attractive group.

* * * * *